US006621059B1

(12) United States Patent
Harris et al.

(10) Patent No.: US 6,621,059 B1
(45) Date of Patent: Sep. 16, 2003

(54) WEAPON SYSTEMS

(75) Inventors: Douglas George Harris, Maidstone (GB); Rodney Pearson, Maidstone (GB); Andrew Robert Runnalls, Faversham (GB)

(73) Assignee: Bae Systems Electronics Limited, Hampshire (GB)

( * ) Notice: Subject to any disclaimer, the term of this patent is extended or adjusted under 35 U.S.C. 154(b) by 0 days.

(21) Appl. No.: 07/253,093

(22) Filed: Sep. 16, 1988

(30) Foreign Application Priority Data

Sep. 25, 1987 (GB) ..... 8722589

(51) Int. Cl.[7] ..... F41G 7/34; F42B 12/58

(52) U.S. Cl. ..... 244/3.2; 102/384; 102/393; 102/489; 244/3.1

(58) Field of Search ..... 102/384, 387, 102/393, 489; 244/3.1, 3.15, 3.21

(56) References Cited

U.S. PATENT DOCUMENTS 4,372,216 A * 2/1983 Pinson et al. ..... 102/489
4,417,520 A * 11/1983 Maudal ..... 102/489
4,522,356 A * 6/1985 Lair et al. ..... 244/3.15

FOREIGN PATENT DOCUMENTS

DE 3326877 * 2/1985 ..... 102/489

* cited by examiner

*Primary Examiner*—Charles T. Jordan
(74) *Attorney, Agent, or Firm*—Kirschstein, et al.

(57) ABSTRACT

A weapon system comprising a mobile platform (1) e.g. an aircraft incorporating a first three-axis attitude reference sub-system (13), and a guidable vehicle (3) launchable from the platform (1) and incorporating a guidance sub-system (15) incorporating gyros (17) wherein correction of gyro parameters, i.e. scale factor and zero offset, of the vehicle attitude reference sub-system (15) is effected prior to launch of the vehicle (3) on the basis of repetitive comparisons of attitude data as measured by the platform and vehicle sub-systems (13, 15). The vehicle (3) may comprise a dispenser of a number of munitions (5) each itself incorporating a guidance sub-system (25) incorporating gyros (27), in which case corrections of gyro parameters of the missile guidance sub-system (25) may be effected prior to missile launch on the basis of repetitive comparisons of attitude data as measured by the dispenser and munition sub-systems (15, 25).

14 Claims, 4 Drawing Sheets

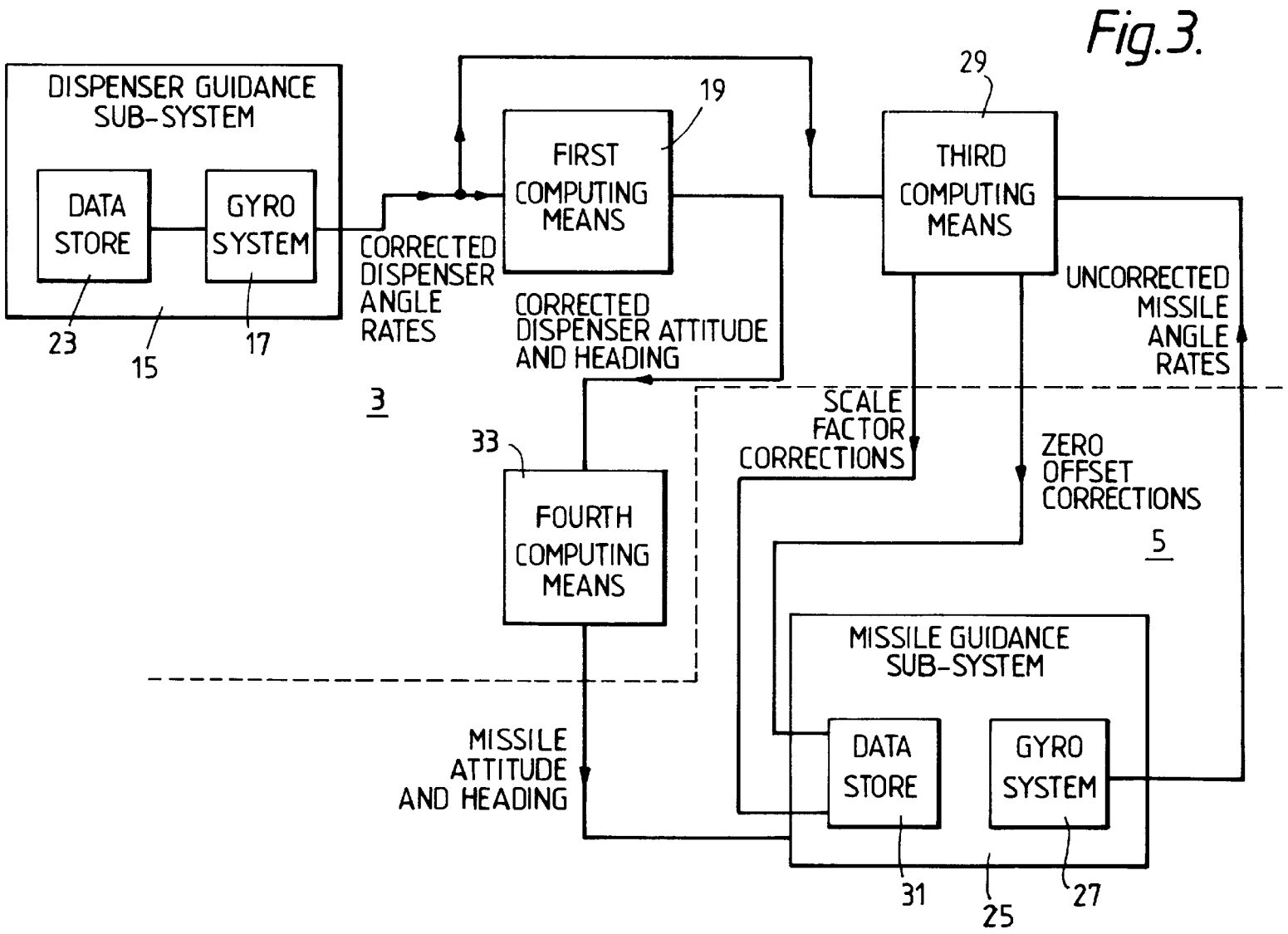
Fig.3.
THIRD COMPUTING MEANS
29
UNCORRECTED MISSILE ANGLE RATES
ZERO OFFSET CORRECTIONS
5
MISSILE GUIDANCE SUB-SYSTEM
GYRO SYSTEM
27
25
DATA STORE
31
SCALE FACTOR CORRECTIONS
FIRST COMPUTING MEANS
19
CORRECTED DISPENSER ATTITUDE AND HEADING
FOURTH COMPUTING MEANS
33
MISSILE ATTITUDE AND HEADING
CORRECTED DISPENSER ANGLE RATES
3
DISPENSER GUIDANCE SUB-SYSTEM
GYRO SYSTEM
17
DATA STORE
23
15

WEAPON SYSTEMS

BACKGROUND OF THE INVENTION

1. Field of the Invention

This invention relates to weapon systems.

More especially, though not exclusively, the invention is concerned with guidance and control systems for air-to-ground stand-off weapon systems.

2. Description of the Related Art

In many modern concepts such weapons systems, particularly for those intended for use against armoured formations and similarly dispersed targets, are conceived to consist of a guidable vehicle, which on being launched from an aircraft executes a trajectory to bring it to a suitable height and attitude above a target area either to itself attack a target, or to dispense a number of munitions for attacking targets, which munitions may themselves be terminally guided or not.

For example, in one such concept for a weapon system for use against armoured formations, the dispenser is unpowered, and contains eight terminally guided munitions. The dispenser is launched from the aircraft at low altitude. After release from the aircraft, the dispenser is first retarded to ensure that the launch aircraft can get clear, and then proceeds for a specified distance whilst maintaining as closely as possible the track angle which pertained at the time of release, in order to reach the target area. On approaching the target area, the dispenser executes a pull-up manoeuvre to achieve an altitude such that, when the munitions are released, their sensors will have a sufficient area within their collective field of view that there will be a good probability of acquiring many of the available targets. Having achieved such an altitude, the dispenser will place itself in a suitable attitude for releasing the munitions, and then eject them in an appropriate pattern. After ejection, each munition will continue in forward flight with its terminal sensor pointing downwards until the sensor acquires a target, whereupon the munition is guided down onto the target under the control of its sensor.

For such weapon systems, the guidance and control of the launched vehicle will normally impose a requirement for the measurement of its attitude, heading and angular rates. Likewise, in the case where the launched vehicle dispenses munitions which are terminally guided, there will normally be a requirement for the measurement of the angular orientation and angular rates of the munitions and/or their sensor heads. At the same time, the economic feasibility of the weapon system will require that all components of the weapon, particularly those replicated on each munition, be of low cost.

SUMMARY OF THE INVENTION

It is an object the present invention to provide a weapon system of the kind comprising a mobile platform incorporating an attitude reference sub-system and a guidable vehicle launchable from said platform and itself incorporating a guidance sub-system wherein the vehicle guidance sub-system may be of relatively low cost.

According to the present invention there is provided a weapon system comprising a mobile platform incorporating a first three-axis attitude reference sub-system; and a guidable vehicle launchable from the said platform and incorporating a guidance sub-system incorporating gyros; and wherein in operation of the system the attitude data of the platform and the vehicle are repetitively compared during a period of time before vehicle launch, being a period terminating substantially at the moment of launch of the vehicle from the platform, and at least one of the factors scale factor and zero offset currently being exhibited by each of the gyros of the vehicle guidance sub-system is estimated and a desired correction thereof effected using the differences in attitude data, as revealed by the said repetitive comparison, during a period of time terminating substantially at the said moment of vehicle launch.

In one particular weapon system according to the invention said vehicle is a munition dispenser, whose guidance sub-system incorporates a second three axis attitude reference sub-system, and which carries a multiplicity of guidable munitions launchable from the said dispenser and each incorporating a guidance and/or stabilisation sub-system incorporating gyros; and in operation of the system attitude data of the dispenser and each of the said munitions are repetitively compared during a period of time terminating substantially at the moment of launch of the relevant munition from the dispenser, and at least one of the factors scale factor and zero offset currently being exhibited by each of the gyros of each of the munition sub-systems is estimated and a desired correction thereof effected using the differences in attitude data, as revealed by the said repetitive comparison of attitude data of the dispenser and each of the said munitions, during a time period terminating substantially at the moment of launch of the relevant munition.

One advantage of the present invention arises from the fact that the correction of scale factor and/or zero offset of the gyros, i.e. in the dispenser and/or munitions guidance sub-systems, enables certain types of low-cost gyroscopes to be used in these sub-systems, e.g gyroscopes based on the vibrating element principle, wherein the stability of the gyro error parameters, particularly zero offset, over periods of operation of several minutes is very much better than their stability and repeatedly on a switch-on to switch-on basis, or in the face of large temperature variations. The poor stability and repeatability on a switch-on to switch-on basis and with large temperature variations of such gyros is overcome in a system according to the invention, and furthermore this is not negated by the possible severe manoeuvres and large attitude excursions to which the gyros may be subjected in operation.

A further feature of a system according to the invention is that if it may not be possible to satisfactorily estimate and correct the scale factor or zero offset of the gyro. Such an eventuality clearly prevents satisfactory operation of the system and can be used to provide a warning to the system operator that it may not be desirable to continue operation of the system, and that it may be desirable to abort the entire sortie rather than expose the platform, which may be a very costly aircraft, to danger in continuing with the sortie.

By a gyroscope based on the vibrating element principle is meant a gyroscope incorporating an element, normally in the form of a cylinder or disc, which is caused to vibrate in operation, the pattern of vibrations being caused to shift in response to angular movement about an axis of the element, the shift being detected to form the basis of the gyroscope output.

BRIEF DESCRIPTION OF THE DRAWINGS

One weapon system in accordance with the invention, and several modifications thereof, will now be described, by way of example, with reference to the accompanying drawings in which:

FIGS. 2, 3 and 4 illustrate various parts of the system at different stages of its operation.

DETAILED DESCRIPTION OF THE PREFERRED EMBODIMENTS

Figure 1:
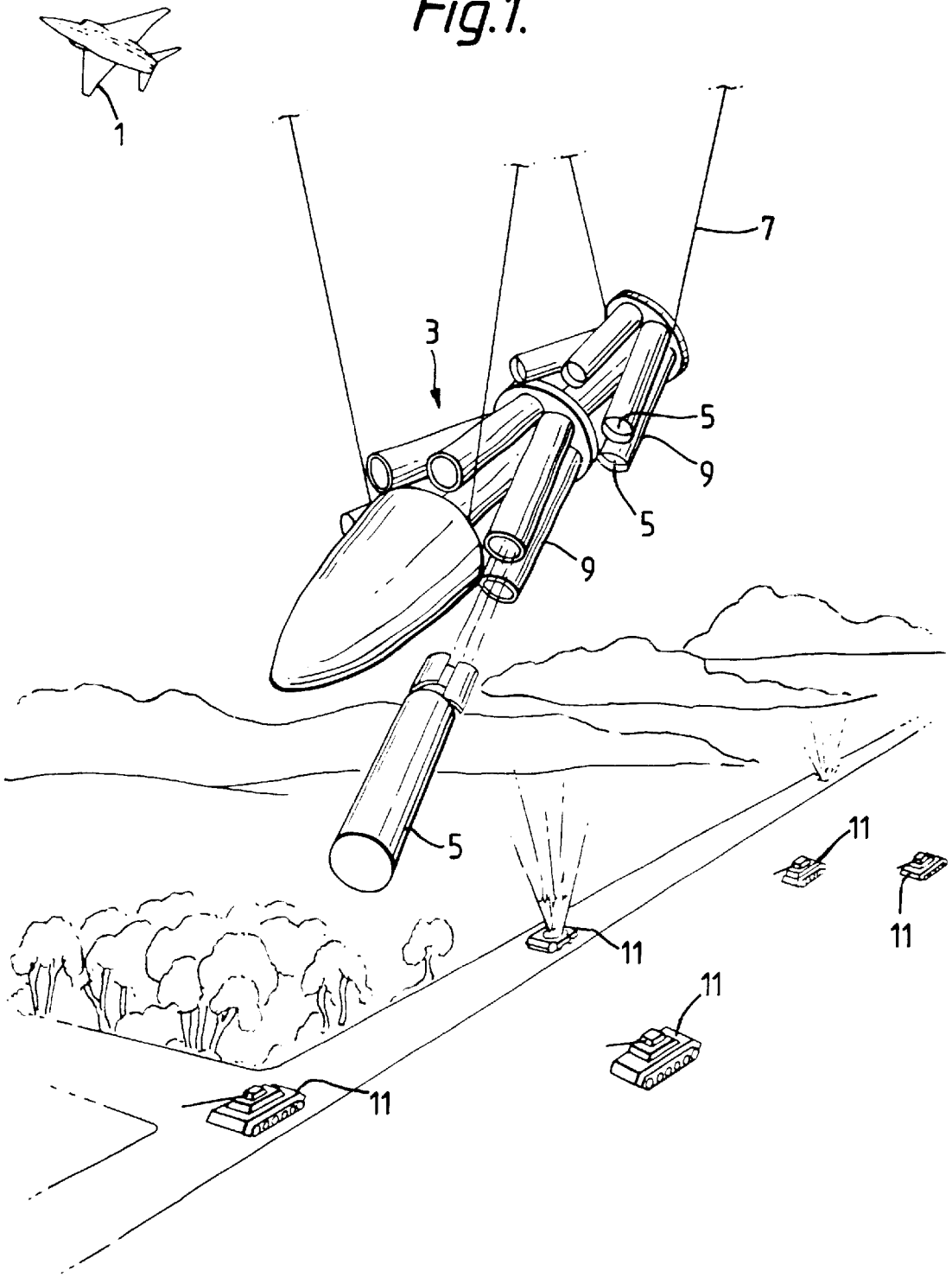
FIG. 1 is an overall view of the system in operation.

Referring to FIG. 1, the system is an air-to-surface missile system comprising a mobile platform in the form of an aircraft 1, a guidable vehicle which is launchable from the aircraft 1 and is in the form of a missile dispenser 3, and a number of guidable munitions in the form of guided missiles 5 launchable from the dispenser 3. In FIG. 1 the dispenser 3 is shown after launch from the aircraft 1 supported above a target area by a parachute 7. The missiles 5 are initially housed in missile launch tubes 9 carried by the dispenser 3, one missile 5 being shown in FIG. 1 just after launch from the dispenser 3 whilst other missiles 5 have already reached selected targets 11 in the target area.

Figure 2:
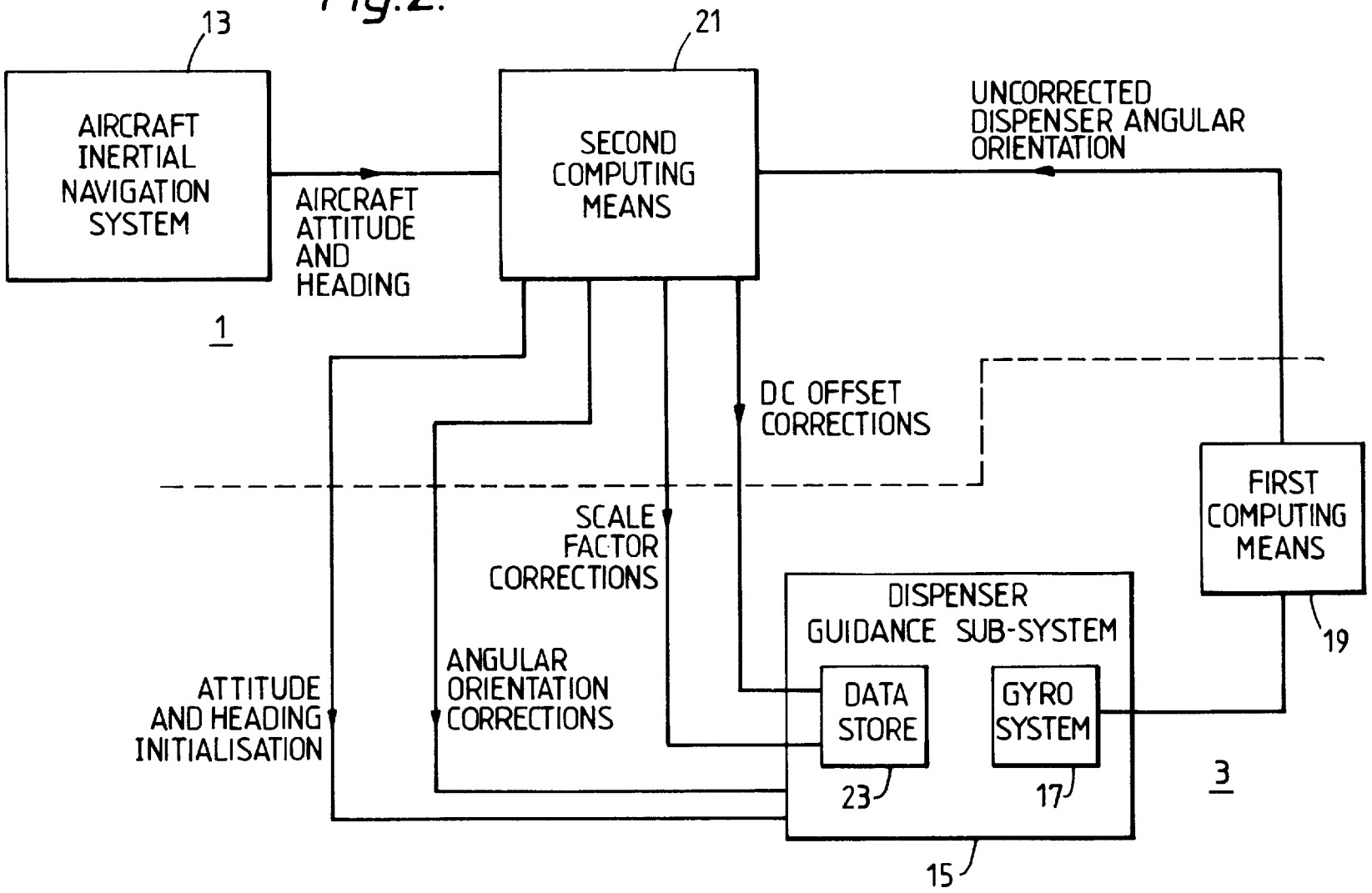

Refering now also to FIG. 2 which illustrates the system before dispenser launch and FIG. 3 which illustrates the dispenser 3 after launch before missile launch, the aircraft has a conventional inertial navigation system (INS) 13. The dispenser has a guidance sub-system 15 incorporating a vibrating disc or cylinder type gyro system 17 arranged to measure the components of the dispenser's angular rate about three orthogonal axes, e.g. pitch, roll and yaw rates. Typically single axis gyros are used so that the gyro system 17 comprises three gyros on mutually orthogonal axes. It will be noted that no accelerometers are used in the dispenser guidance system for the purposes of the present invention. The dispenser 3 also carries a first computing means 19 arranged to utilise sampled angular rate outputs of the dispenser gyro system 17 to solve a set of differential equations relating the angular rates to the angular orientations i.e. attitude and heading of the gyro system 17, as is characteristic of strapdown attitude and heading reference systems.

The aircraft 1 carries a second computing means 21 arranged to receive measurements of the aircraft attitude and heading from the aircraft INS 13. The second computing means 21 compares these measurements with the angular orientations determined periodically by the first computing means 19 at corresponding times. The second computing means 21 uses these comparisons firstly to generate corrections to the angular orientations of the dispenser 3 as measured by the first comptuting means 19, thus ensuring that the corrected measurements become and remain accurate with respect to a defined datum for attitude and heading. Secondly these comparisons are used to estimate, and thence generate corrections for, the zero offsets of the gyros of the dispenser gyro system 17, and also likewise to estimate and correct for scale factor errors, and possibly other gyro error parameters, of these gyros. All of this is suitably accomplished within the second computing means by means of a Kalman filter or similar algorithm. The corrections generated by the second computing means 21 may be utilised to adjust the computations of the first computing means 19 to take account of them. Alternatively the second computing means 21 may simply apply the corrections to the output of the first computing means 19.

The corrections may be fed to and held in a data store 23 in the dispenser 3 and utilised to correct the gyro parameters just prior to dispenser launch, as indicated by the absence of a connection between the data store 23 and gyro system 17 in FIG. 2. Alternatively the corrections may be used on a running basis but this requires running adjustments to the algorith used in the second computing means 21.

To effect the above described operations power is applied to the dispenser 3 some time, typically between five and thirty minutes, before it is launched from the aircraft 1 at least until the missiles 5 are all launched. The computations carried out by the first computing means 19 are suitably initialised using values of attitude and heading derived from the aircraft INS 13. Alternatively these computations may be initialised at some arbitrary datum, the computations subsequently being adjusted by the second computing means 21 so as to refer to some defined datum for attitude and heading.

The second computing means 21 is operative from the time the dispenser 3 is switched on until the dispenser 3 is launched, by which time it will have accurately established the dispenser's attitude and heading to the defined datum, and have calibrated the dispenser gyros 17 to an accuracy substantially in excess of their accuracy at switch-on.

If the measurements of angular orientation passed from the first computing means 19 to the second computing means 21 are not in themselves adequately synchronised with the measurements received from the aircraft INS 13 to allow the comparison process to be carried out effectively, the second computing means may interpolate between successive measurements received from one of these two sources 13, 19 to produce values of angular orientation corresponding in time to the measurements received from the other source. Additionally or alternatively, the second computing means 21 may examine the angular rates measured by the dispenser gyros 17 and refrain from carrying out the comparison process during periods when the dispenser 3 is found to be subject to relatively high angular rates, thus avoiding the need for particularly accurate synchronisation which would be necessary for effective use of the comparison process during such periods.

In a modification of the weapon system the second computing means 21 is carried by the dispenser 3 instead of by the aircraft 1, in which case it may be arranged to receive inputs from the aircraft INS 13 and be configured to continue to apply corrections to the outputs of the first computing means 19 after launch of the dispenser 3.

In another modification of the system, the aircraft INS 13 may be arranged to apply angular rate inputs to the second computing means, in which case the first computing means 19 is not required and angular rate outputs from the dispenser gyro system 17 are applied directly to the second computing means 21.

Figure 4:
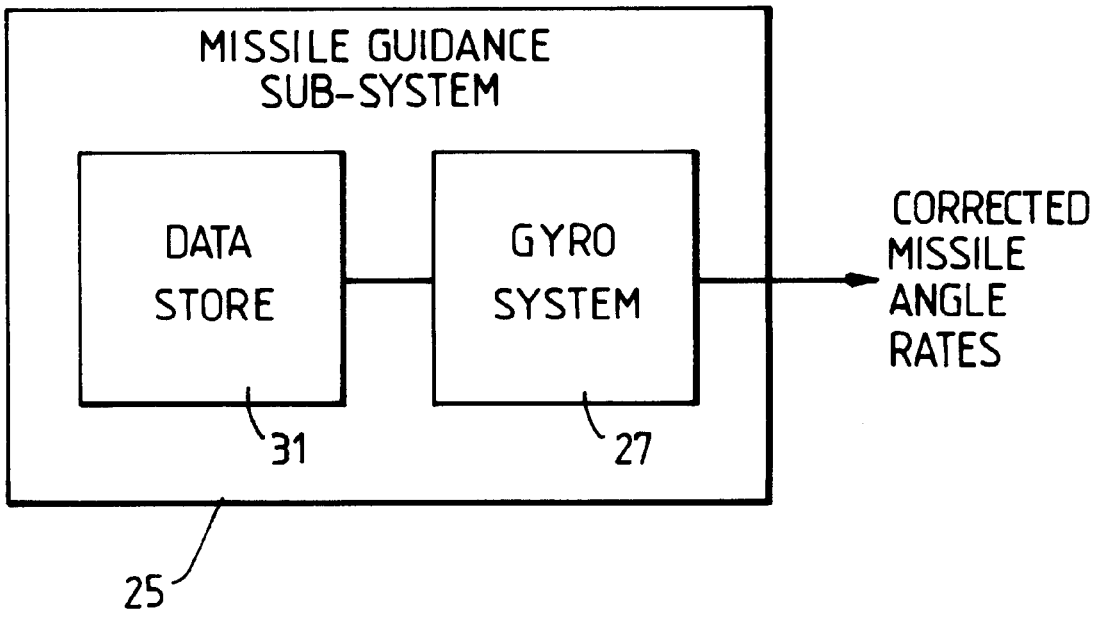

Referring now particularly to FIGS. 3 and 4 (which shows a missile after launch), each of the missiles 5 has a guidance sub-system 25 incorporating a vibrating disc or cylinder type gyro system 27, and the dispenser 3 contains suitable electronics and interfacing (not shown) to allow the gyro system 27 in each missile 5 to be powered up continuously from the time that the dispenser 3 is powered up.

The dispenser 3 further includes a third computing means 29 which samples the angular rates measured by the gyro system 27 of each missile 5. For each of the missiles 5, the third computing means 29 periodically samples the angular rates measured by the dispenser gyro system 17, as calibrated by the second computing means 21, and forms the resultant of these rates along an axis parallel to the sensitive axis of that munition's gyroscope system 27. The third computing means 29 then compares this resultant with a measurement taken at the corresponding time by the missile gyro system 27 itself. On the basis of such periodic comparisons, the third computing means 29 estimates for each missile gyro system 27 its zero offsets, scale factor errors, and possibly other gyro error parameters, and thence generates corrections for thse parameters and applies them to the munition gyro systems 27 i.e. via a data store 31 in corresponding manner to that described above in relation to the second computing means 21 and dispenser gyro system 17. For this purpose a simple statistical regression procedure will normally be adequate. Alternatively a recursive estimation procedure can be used.

The third computing means 29 is arranged to be operative at least from the time that calibration corrections computed by the second computing means 21 have begun to settle, and possibly before this time, until the missiles 5 are launched.

In addition to applying the above mentioned corrections to each missile gyro system 27, the dispenser 3 further includes fourth computing means 33 for downloading to each missile 5 prior to its launch the instantaneous attitude and heading of that missile as determined from the attitude and heading of the dispenser 3, as computed by the first computing means 19 and corrected by the second computing means 21, and from the known angular orientation of that missile 5 relative to the dispenser 3 prior to launch from the dispenser 3.

Thus the third and fourth computing means 29 and 33 with their associated interfacing and electronics, by the time each missile 5 is launched, will firstly have enabled the missile guidance system 25, whose further purpose and details are irrelevant to the present invention, to establish accurately the missile's attitude and heading with respect to the defined datum, and secondly will have applied calibration corrections to the missile gyro system 27 to an accuracy substantially in excess of its accuracy at switch-on.

In a further modification of the system the functions of the third computing means 29 may be carried out by computing means (not shown) carried by the missiles 5 themselves. In such cases suitable interfacing and electronics must be provided to furnish each such missile computing means periodically with measurements of the angular rates measured by the dispenser gyro system 17 as calibrated by the second computing means 21. However, this will normally mean an unnecessary replication of the third computing means 29.

Similarly the function of the fourth computing means 33 of the dispenser 3 may be carried out by computing means (not shown) in each missile 5. In this case it will, of course, be instantaneous attitude and heading of the dispenser 3 rather than that of the missile 5 which is downloaded to a missile 5 prior to its launch.

We claim:

1. A weapon system comprising: a mobile platform incorporating a first three-axis attitude reference sub-system producing attitude data; a guidable vehicle launchable from the said platform and incorporating a guidance sub-system producing attitude data and incorporating gyros exhibiting scale factors and zero offsets; means for repetitively comparing attitude data of the platform and the vehicle during a period of time before vehicle launch, being a period terminating substantially at the moment of launch of the vehicle from the platform, and means for estimating at least one of the scale factor and zero offset currently being exhibited by each of the gyros of the vehicle guidance sub-system and effecting a desired correction thereof using the differences in attitude data, as revealed by the said repetitive comparison, during a period of time terminating substantially at the said moment of vehicle launch.

2. A system according to claim 1 wherein said platform is an aircraft.

3. A system according to claim 2 wherein said first attitude reference sub-system forms part of an inertial navigation system of the aircraft.

4. A system according to claim 1 wherein said means for repetitively comparing comprises computing means carried by said platform.

5. A system according to claim 1 wherein said comparisons are effected on the basis of a comparison of angular orientations of the platform and vehicle.

6. A system according to claim 1 wherein said comparisons are effected on the basis of comparisons of angular rates of the platform and vehicle.

7. A system according to claim 1 wherein said gyros are gyros based on a vibrating element principle.

8. A system according to claim 1 including means for utilising said comparisons to effect a correction of the attitude and heading of the vehicle as measured by the vehicle guidance sub-system.

9. A system according to claim 2 wherein: said vehicle is a munition dispenser, whose guidance sub-system incorporates a second three axis attitude reference sub-system providing attitude data, and which carries a multiplicity of guidable munitions launchable from the said dispenser and each incorporating a guidance and/or stabilisation sub-system providing attitude data and incorporating gyros exhibiting scale factors and zero offsets; means for repetitively comparing attitude data of the dispenser and each of the said munitions during a period of time terminating substantially at the moment of launch of the relevant munition from the dispenser, and means for estimating at least one of the scale factor and zero offset currently being exhibited by each of the gyros of each of the munition sub-systems and effecting a desired correction thereof using the differences in attitude data, as revealed by the said repetitive comparison of attitude data of the dispenser and each of the said munitions, during a time period terminating substantially at the moment of launch of the relevant munition.

10. A system according to claim 9 wherein said munitions are guided missiles.

11. A system according to claim 9 wherein said means for repetitively comparing attitude data of the dispenser and munitions comprises computing means carried by the dispenser.

12. A system according to claim 9 wherein said comparisons of attitude data of the dispenser and munitions are effected on the basis of comparisons of angular rates of the dispenser and munitions.

13. A system according to claim 9 wherein said gyros of the munition guidance and/or stabilisation sub-systems are gyros based on a vibrating element principle.

14. A system according to claim 9 further including means for downloading from the dispenser to each munition, prior to launch of that munition, the attitude and heading of that munition, as determined by the dispenser attitude reference sub-system.

* * * * *